US005192114A

United States Patent [19]

Hollington et al.

[11] Patent Number: 5,192,114

[45] Date of Patent: Mar. 9, 1993

[54] TILT ADJUSTMENT CONTROL FOR A CHAIR

[75] Inventors: Geoffrey A. Hollington, London, England; Robert A. Nagelkirk, Zeeland, Mich.; Lynne M. Allen; Mark E. Kuyper, both of Holland, Mich.

[73] Assignee: Herman Miller, Inc., Zeeland, Mich.

[21] Appl. No.: 666,881

[22] Filed: Mar. 8, 1991

Related U.S. Application Data

[62] Division of Ser. No. 317,582, Mar. 1, 1989.

[51] Int. Cl.[5] ..... A47C 1/032

[52] U.S. Cl. ..... 297/304; 297/301

[58] Field of Search ..... 297/301, 302, 304, 317, 297/322, 342, 357

[56] References Cited

U.S. PATENT DOCUMENTS

| | | | |
|---|---|---|---|
| 2,272,980 | 2/1942 | McLellan . | |
| 2,321,385 | 6/1943 | Herold . | |
| 2,471,024 | 5/1949 | Cramer . | |
| 2,479,175 | 8/1949 | McArthur . | |
| 2,662,582 | 5/1949 | Lorenz . | |
| 2,686,558 | 8/1954 | Fox . | |
| 2,956,619 | 10/1960 | Scherer . | |
| 2,961,035 | 11/1960 | Lorenz . | |
| 3,402,964 | 9/1968 | Williams . | |
| 3,758,157 | 9/1973 | Fries . | |
| 3,881,772 | 5/1975 | Mohrman . | |
| 4,314,728 | 2/1982 | Faiks . | |
| 4,328,943 | 5/1982 | Eldon, III . | |
| 4,375,301 | 3/1983 | Pergler et al. . | |
| 4,390,206 | 6/1983 | Faiks et al. . | |
| 4,408,800 | 10/1983 | Knapp . | |
| 4,432,582 | 2/1984 | Wiesmann et al. . | |
| 4,438,898 | 3/1984 | Knoblauch et al. . | |
| 4,451,085 | 5/1984 | Franck et al. . | |
| 4,479,679 | 10/1984 | Fries et al. . | |
| 4,498,702 | 2/1985 | Raftery | 297/312 |
| 4,537,445 | 8/1985 | Neuhoff | 297/322 X |
| 4,589,697 | 5/1986 | Bauer et al. . | |
| 4,640,547 | 2/1987 | Fromme . | |
| 4,652,050 | 3/1987 | Stevens . | |
| 4,653,806 | 3/1987 | Willi | 297/300 |
| 4,695,093 | 9/1987 | Suhr et al. | 297/300 |
| 4,709,963 | 12/1987 | Uecker et al. . | |
| 4,743,065 | 5/1988 | Meiller et al. . | |
| 4,744,600 | 5/1988 | Inoue . | |
| 4,776,633 | 10/1988 | Knoblock et al. . | |
| 4,830,431 | 5/1989 | Inoue | 297/304 X |
| 4,832,402 | 5/1989 | Zund . | |
| 4,858,993 | 8/1989 | Steinmann . | |
| 4,889,384 | 12/1989 | Sulzer | 297/304 X |
| 4,981,326 | 1/1991 | Heidmann | 297/304 |
| 4,984,846 | 1/1991 | Ekornes . | |
| 4,986,601 | 1/1991 | Inoue . | |
| 4,988,145 | 1/1991 | Engel . | |

FOREIGN PATENT DOCUMENTS

| | | |
|---|---|---|
| 691437 | 4/1940 | Fed. Rep. of Germany . |
| 3322450 | 1/1985 | Fed. Rep. of Germany . |
| 164790 | 10/1933 | Sweden . |
| 273039 | 1/1951 | Sweden . |
| 15751 | of 1914 | United Kingdom . |
| 222898 | 10/1924 | United Kingdom . |
| 385157 | 12/1932 | United Kingdom . |
| 770169 | 3/1957 | United Kingdom . |
| 794138 | 4/1958 | United Kingdom . |
| 1278501 | 6/1972 | United Kingdom . |

*Primary Examiner*—Peter R. Brown

*Attorney, Agent, or Firm*—Varnum, Riddering, Schmidt & Howlett

[57] ABSTRACT

A chair comprises a base, a column on the base, a housing on the column and supporting a chair seat and back, a height adjustment means mounted to and between the base and the housing for longitudinal adjustment to alter relative height of the seat. The chair also includes a tilt adjustment means comprising a chair back support means pivotally mounted to the housing for movement between upright and reclining positions, means for biasing the chair back support means in the upright position, tension control means movably engageable with the biasing means for adjusting tension thereof and tilt actuating means movably mounted to the housing for actuating movement of the tension control means. The tilt actuating means comprises an elongated rod rotatably mounted to the housing. The height actuating means comprises an elongated tube rotatably mounted to the housing in telescopic relationship to the actuating rod.

33 Claims, 5 Drawing Sheets

TILT ADJUSTMENT CONTROL FOR A CHAIR

This is a division of U.S. application Ser. No. 07/317,582, filed Mar. 1, 1989, and now pending.

FIELD OF THE INVENTION

The invention relates to a chair and, more particularly, to mechanisms for adjusting the tilt of a chair.

BACKGROUND OF THE INVENTION

Chairs having mechanisms permitting tilting of the chair backs, normally being biased in upright positions, are disclosed in U.S. Pat. Nos. to Faiks et al. 4,390,206, issued Jun. 28, 1983; Knoblauch et al. 4,373,692, issued Feb. 15, 1983, and 4,438,898 issued Mar. 27, 1984; Faiks 4,314,728, issued Feb. 9, 1982; Fox 2,686,558, issued Apr. 27, 1950; Fries et al. 4,479,679, issued Oct. 30, 1984; Neuhoff 4,537,445, issued Aug. 27, 1985; Eldon III 4,328,943, issued May 11, 1982; McLellan et al. 2,272,980, issued Feb. 10, 1942; Scherer 2,956,619, issued Oct. 18, 1960; Cramer 2,471,024, issued May 24, 1949; and Franck et al. 4,451,085, issued May 29, 1984. Some of these patents disclose chairs having control means for adjusting tension of biasing means normally urging the chair backs in the upright positions. See, for example, Faiks et al., Knoblauch et al., Faiks, Scherer, Cramer, Fries et al., and Eldon III.

SUMMARY OF THE INVENTION

According to the invention, a chair has a base, a column mounted on the base and a tilt adjustment mechanism comprising a housing mounted on the column, chair back support means pivotally mounted on the housing for movement between reclining and upright positions, chair seat support means mounted on the housing for movement in rearward and forward directions and operably connected to the chair back support means, biasing means mounted on the housing and biasing the seat support means and the back support means in the upright and forward positions, respectively, an adjustable tension control means for adjusting tension of the biasing means. The tension control means operably engages the biasing means, is mounted for transverse movement relative to the rearward and forward directions and for movement in the rearward and forward directions, and comprises force transmitting means for translating the transverse movement of the tension control means into movement of the control means in the forward and rearward directions to increase. and decrease, respectively, tension of the biasing means.

The tension control means comprises a first blocklike member mounted in the housing for reciprocal movement in first and second directions transverse of the rearward and forward directions, a second blocklike member engaging the biasing means and mounted in the housing for reciprocal movement in the forward and rearward directions, and means for actuating reciprocal movement of the first member in the first and second directions, the force transmitting means being adapted to coact between the first and second members to translate movement of the first member in the first and second directions into movement of the second member in the forward and rearward directions to increase and decrease, respectively, tension of the biasing means.

The force transmitting means comprises complementary planar surfaces on the first and second blocklike members and interengaged in a substantially common plane forming an acute angle greater than 0° relative to directional movement of the first blocklike member.

The actuating means comprises a rod mounted to the housing for rotational movement in tension and release directions. The first blocklike member is mounted to the actuating rod for movement longitudinally thereof in the first and second directions. The tension control means further comprises second forced transmitting means for translating rotational movement of the rod in the tension and release directions into movement of the first blocklike member in the first and second directions, respectively. In this manner, rotation of the actuating rod in the tension and release directions moves the first member in the first and second directions and the second member in the forward and rearward directions to increase and decrease, respectively, tension of the biasing means.

BRIEF DESCRIPTION OF THE DRAWINGS

The invention will now be described with reference to the drawings in which.

DESCRIPTION OF THE PREFERRED EMBODIMENTS

Figure 1:
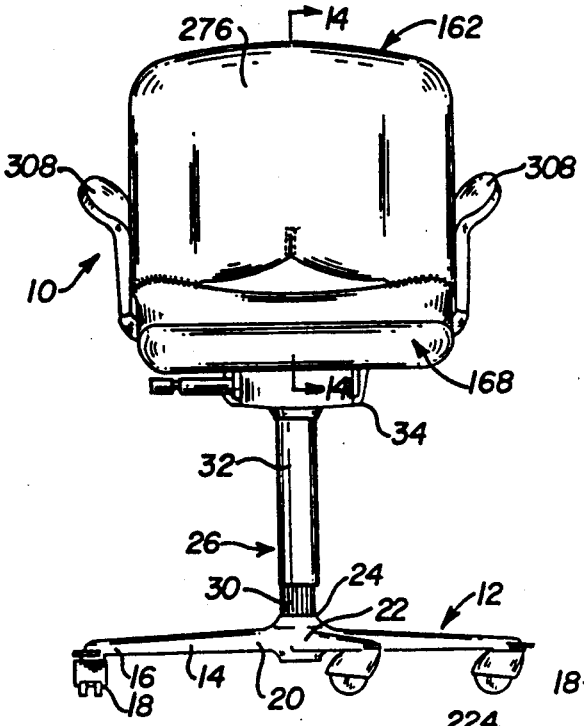
FIG. 1 is a front elevational view of a chair in accordance with the invention.
Figure 2:
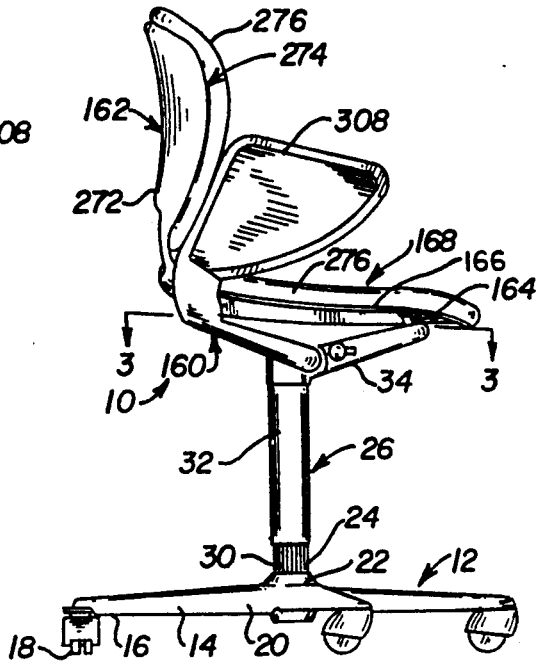
FIG. 2 is a side elevational of the chair shown in FIG. 1.

The principles of the invention are disclosed, by way of example, in a chair 10 as generally shown in FIGS. 1 and 2. Individual components of the chair 10 are further shown in FIGS. 3–15. As described in detail herein, the chair 10 includes a tilt mechanism for providing rearward and downward adjustment of the chair back and seat relative to normally upright and forward positions of the back and seat and a mechanism for adjusting height of the chair back and seat relative to a chair base.

Referring specifically to FIGS. 1 and 2, the chair 10 comprises a castered base 12 having five equidistantly spaced arms 14 mounting at outer ends 16 thereof floor engaging casters 18. Inner ends 20 of the arms 14 are connected by a central web 22 having a central socket 24 therethrough. The arms 14 and the central web 22 are preferably a casted one-piece aluminum member. Although the base 12 is illustrated as having five arms, any other number of arms can be used to provide the necessary support for the chair, so long as the number is sufficient to provide stability to the chair. Further, other conventional chair bases may be substituted for that illustrated and described without departing from the spirit and scope of the invention.

Figure 4:
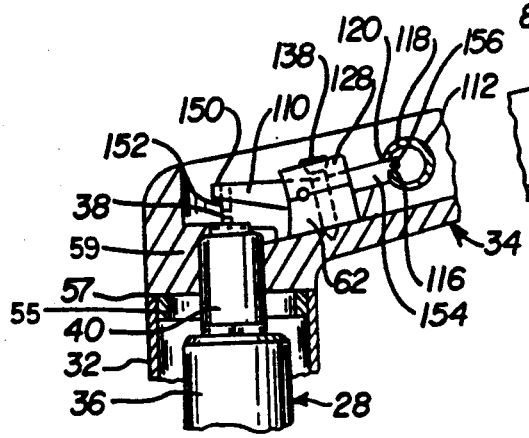
FIG. 4 is a sectional view of the housing taken along lines 4—4 of FIG. 3.

In addition, the chair 10 includes an adjustable column 26. As shown in FIGS. 1, 2, and 4, the column 26 includes a pneumatic air spring 28 (hereinafter sometimes the "extendable means") positioned within a pair of telescoping inner and outer cover tubes 30, 32. The air spring 28 is mounted to and between the base 12 and a housing 34 (hereinafter sometimes the "support means") of the chair.

Specifically, the air spring 28 comprises a piston (not shown and hereinafter sometimes the "first member") securely mounted to the web 22 and a cylinder 36 (hereinafter sometimes the "second member") mounted to the housing 34 as described in detail below. The air spring 28 further includes a pin 38 (hereinafter sometimes the "lock means") projecting upwardly from an upper axial end 40 of the cylinder 36. The pin 38 is adapted to move between an upper locked position, where the cylinder 36 and the piston are held in stationary locked engagement, and a lower unlocked position, where the cylinder and the piston are released for movement relative to each other to extend or contract the air spring 28 longitudinally. The pin 38 is normally biased in the upper locked position by compressed gas (hereinafter sometimes the "biasing means") housed within the cylinder.

The inner cover tube 30 is mounted on the web 22 over the air spring 28, and in particular the piston. The outer cover tube 32 is mounted to the chair housing 34 over the cylinder 36 as described below.

Referring to FIGS. 3–6, the housing 34 is generally pentagonal in shape and comprises a bottom wall 42, a front wall 44, a pair of parallel side walls 46 and a pair of identical rearwardly converging back walls 48. The bottom wall 42 has an opening 50 therethrough at a rear portion 52 of the housing and at an apex 54 defined by the converging back walls 48. The housing 34 further includes a first hollow cylindrical portion 55 forming a downward extension of the opening 50 and having a portion 57. A second hollow cylindrical portion 59 forms an upward pension of the opening 50.

In addition, the housing 34 includes pairs of transverse and longitudinal flanges 56, 58, 60, 62 formed integral with and extending upwardly from the housing bottom and side walls 42, 46. The flanges 56, 58 extend inwardly a predetermined distance from the side walls 46 along transverse axes of the housing 34. The flanges 60 extend forwardly a predetermined distance from inner edges 64 of the flanges 58 along longitudinal axes of the housing 34. A central longitudinal groove 66 is formed in the bottom wall 42. The flanges 56, 58, 60 and the groove 66 function in connection with the tilt adjustment mechanism as discussed below in detail. The flanges 62 are positioned between the opening 50 and the flanges 56 and along longitudinal axes of the housing 34 adjacent the rear portion 52 thereof. The flanges 62 function in connection with the height adjustment mechanism as hereinafter described.

The housing 34 also includes a pair of shoulders 68 at a front portion 70 of the housing 34 on opposite lateral sides 88, 90 thereof. Each shoulder 68 includes a front step portion 72 having an upper surface 74 which first slopes downwardly and rearwardly and then curves upwardly. Each shoulder 68 has mounted thereon a retainer 76 also having a step portion 78. The step portion 78 has a rearwardly and downwardly curving lower surface 80 complementary to the upper surface 74 of the respective shoulder. Each shoulder 68 and the respective retainer 76 are secured together and to the housing bottom wall 42 by a screw 82 threaded in aligned holes 83 in the retainer, the shoulder and the bottom wall. The complementary upper and lower surfaces 74, 80 form a partially oval slot 84 which slopes slightly downwardly and rearwardly. The slot 84 functions in connection with the tilt adjustment mechanism as described below.

The housing 34 further comprises a pair of through openings 86 positioned at the lateral sides 88, 90 of the housing and extending though gussetlike members 92 at the interface between the housing parallel side walls 46 and the converging back walls 48. The openings 86 function in connection with the tilt adjustment mechanism. The side wall 46 at the housing lateral side 88 has a bore 94 therethrough forward of the socket 86. Another bore 96 transversely aligned with the bore 94 extends partially through the side wall 46 at the lateral side 90 of the housing 34. The transversely aligned bores 94, 96 function in connection with both the tilt and height adjustment mechanisms. The housing 34 is preferably made of an aluminum alloy.

Figure 13:
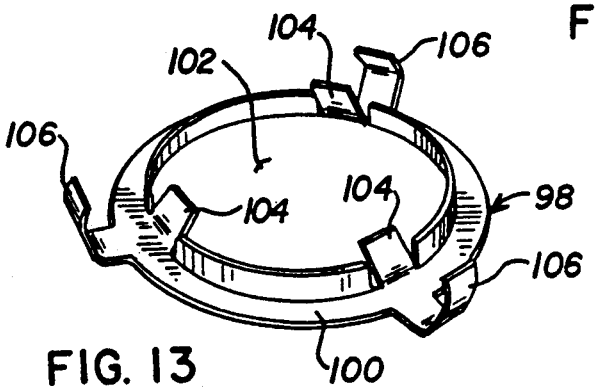
FIG. 13 is a perspective view of a cover tube retaining bracket in accordance with the invention.
Figure 14:
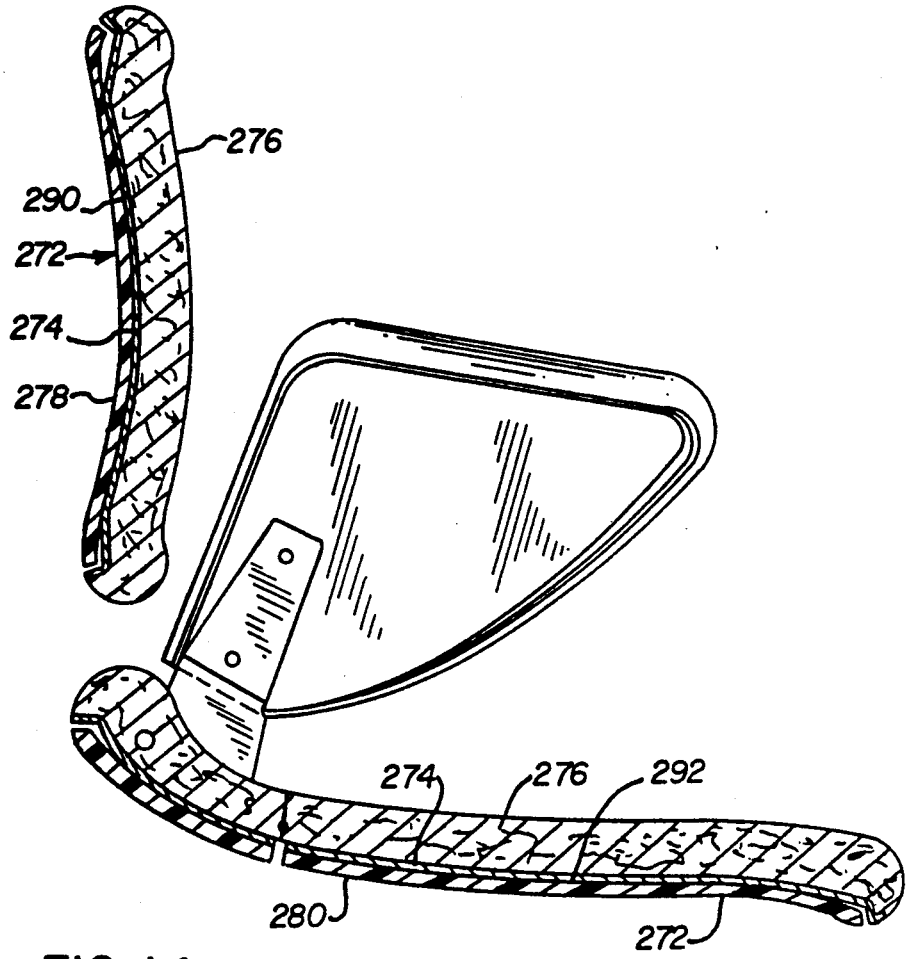
FIG. 14 is a sectional view of the chair seat and back taken along lines 14—14 of FIG. 1.

As stated above, the air spring 28 and the column 26 are mounted to the housing 34. To this end, as shown in FIG. 13, a retainer 98 is provided. The retainer 98 is a ringlike member having a body 100 defining a central opening 102. The retainer 98 further includes a plurality of inwardly and outwardly projecting springlike tabs 104, 106 on the body 100 for securing the column 26 and the air spring 28 to the housing 34. Specifically, the inwardly projecting tabs 104 function to mount the retainer 98 to the lower cylindrical portion 55 of the housing 34 in a compression fit relationship. (See FIG. 4.) The outwardly projecting tabs 106 function to retain the outer cover tube 32 of the column 26 to the housing 34 with the outer cover tube engaging the step portion 57 of the lower cylindrical portion 55 of the housing. The air spring 28 is positioned in registry with the openings 102, 50 in a compression fit relationship to the housing 34.

Referring again to FIGS. 3 and 4, the height adjustment mechanism comprises the air spring 28 heretofore described, a bar 110 (hereinafter sometimes the "lever means") movably mounted to the housing 34 and an actuating tube 112 (hereinafter sometimes the "actuating means") also movably mounted to the housing, the actuating tube being adapted to actuate movement of the bar to engage the pin 38 of the air spring 28 and to move the pin to its unlocked position to permit vertical adjustment of the air spring and thus the chair 10.

The actuating tube 12 is rotatably mounted to the housing side wall 46, at the lateral side 88 of the housing 34, in registry with the bore 94. An inner portion 114 of the tube 112 is positioned within the housing 34 and has a rearwardly facing opening 116 extending through wall 118 of the tube. The opening 116 is defined by an edge 120 of the tube wall 118. An outer portion 122 of the tube 112 is positioned outside of the housing 34 and has telescopically mounted thereon a handle 124 carrying a knob 126 normally positioned in a horizontal orientation.

Figure 18B:
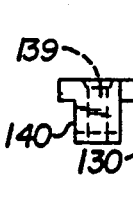
FIG. 18B is a side elevational view thereof.
Figure 18A:
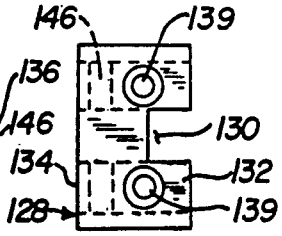
FIG. 18A is a top plan view of a retainer bracket of the height adjustment mechanism in accordance with the invention.
Figure 18C:
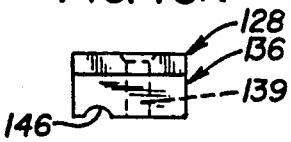
FIG. 18C is a front elevational view thereof.
Figure 19A:
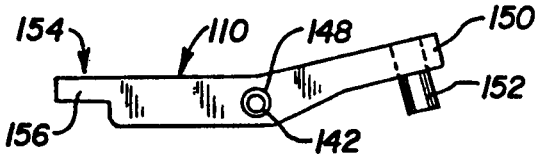
FIG. 19A is a side elevational view of a lever bar of the height adjustment mechanism in accordance with the invention.
Figure 19B:
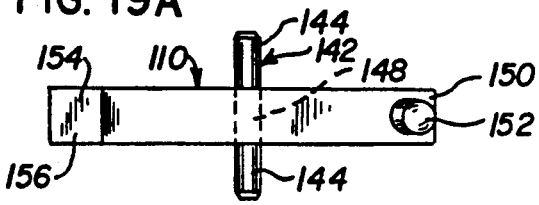
FIG. 19B is a bottom plan view thereof.

The lever means or bar 110 is pivotally mounted to and between the housing flanges 62 for engagement with the air spring 38 to move the same to its unlocked position. To this end, and as shown more clearly in FIGS. 18A–18C, retainer bracket 128 is provided. As shown in FIGS. 18*a*–18*c*, the retainer bracket 128 is a generally rectangular member having a channel 130 therethrough along a central transverse axis between a front 132 of the bracket and a back 134 of the same. The channel 130 extends entirely through the bracket front 132, but merely extends through a bottom portion 136 of the bracket at the back 134. The bracket 128 is mounted to the flanges by a pair of screws 138 extending through two sets of aligned holes 139 in the bracket, the flanges and the bottom wall. The bracket 128 is positioned on the flanges 62 such that the channel 130 is aligned between the flanges. Referring again to FIGS. 3 and 4, and also with reference to FIGS. 19 and 19B, the bar 110 is positioned between the flanges 62 in registry with the channel 130 and is pivotally mounted to the bracket 128 between opposite lower portions 140 thereof defined by and positioned on opposite sides of the channel 130 by a pin 142, opposite ends 144 of which are set in rotatable registry with a pair of aligned sockets 146 in the lower portions 140 and the flanges 62. The pin 142 is received by a central transverse bore 148 of the bar 110 in tight relationship thereto. The channel 130 is of sufficient size to permit free pivotal movement of the bar 110 between the flanges 62.

In an alternative embodiment, the bracket 128 is formed of two bracket parts (not shown) mounted to the flanges 26 in spaced relationship and rotatably carrying the pin 42 between the two bracket parts. In such embodiment, the bar 110 is pivotally carried by the pin between the bracket parts.

A rear end 150 of the bar 110 carries a downwardly depending pin 152 positioned for engagement with the pin 38 of the air spring 28 upon pivotal movement of the bar. A forward end 154 of the bar includes a step portion 156 positioned in registry with the opening 116 through the actuating tube 112. The actuating tube, the bar and the retainer bracket are preferably made of metal. The adjustment knob is preferably formed of plastic.

In operation of the height adjustment mechanism, downward force applied to the knob 126 causes rotation of the actuating tube 112 in a clockwise direction forcing the tube edge 120 against the forward end 154 of the bar 110 to force and move the same upwardly and the rear end 150 of the bar downwardly. Downward movement of the bar rear end 150 forces the downwardly depending pin 152 thereon against the pin 38 of the air spring 28 to move the pin 38, against the biasing force of the pressurized gas contained in the cylinder 36, to its lower unlocked position to release the cylinder from locked engagement relative to the piston (not shown) thereby permitting chair height adjustment. Release of the knob 126, after the desired chair height is attained, permits the biasing means to force the air spring pin 38 to its upper locked position and the bar rear end 150 upwardly to effect downward movement of the bar front end 154. Downward movement of the bar front end 154 forces the step portion 156 thereon against the edge 120 of the actuating tube 112 to effect rotation of the tube in the counterclockwise direction and the handle knob 126 to its original horizontal orientation.

As illustrated in FIGS. 2, 3 and 5–10, the tilt adjustment mechanism comprises means 160 for supporting a back 162 of the chair 10 (hereinafter sometimes the "chair back support means" or the "yoke") and pivotally mounted on the housing 34 for movement between reclining and upright positions; means 164 for supporting a seat 166 of the chair (hereinafter sometimes the "seat support means" or the "plunger") mounted on the housing for movement in forward and rearward directions; means 168 pivotally connecting the chair back support means 160 and the seat support means 164 (hereinafter sometimes the "pivot means"); means 170 biasing the seat support means and the back support means in the forward direction and the upright position, respectively; and tension control means 172 for adjusting the tension of the biasing means.

Figure 3:
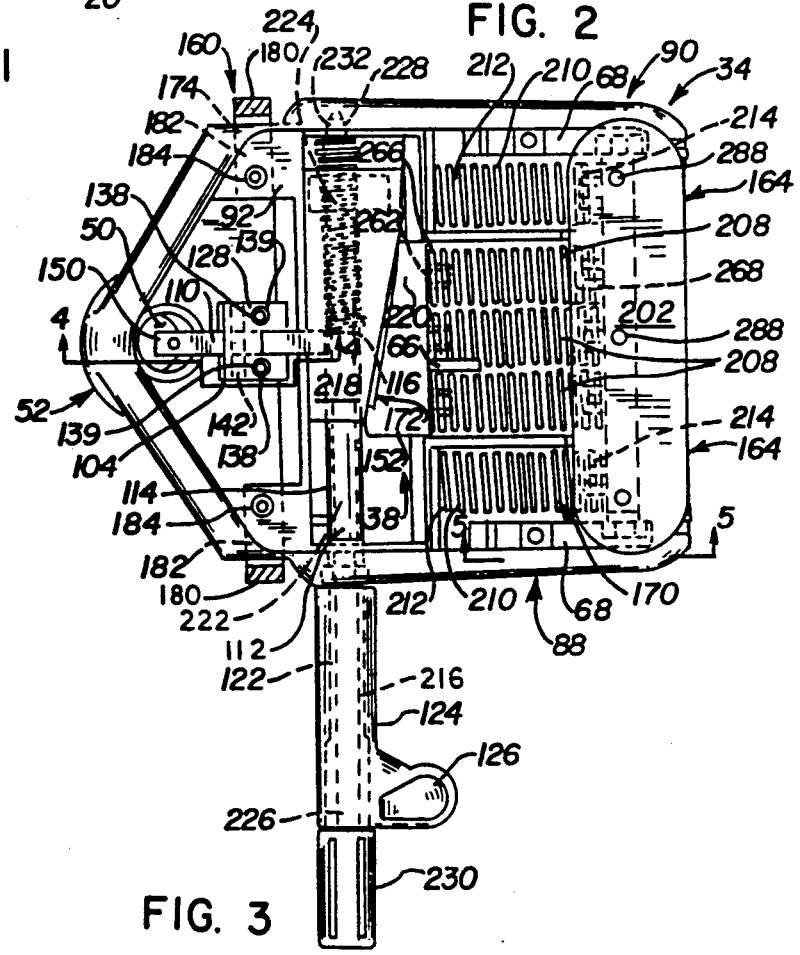
FIG. 3 is a plan view of a housing of the chair, the housing mounting chair tilt and height adjustment mechanisms in accordance with the invention.
Figure 7:
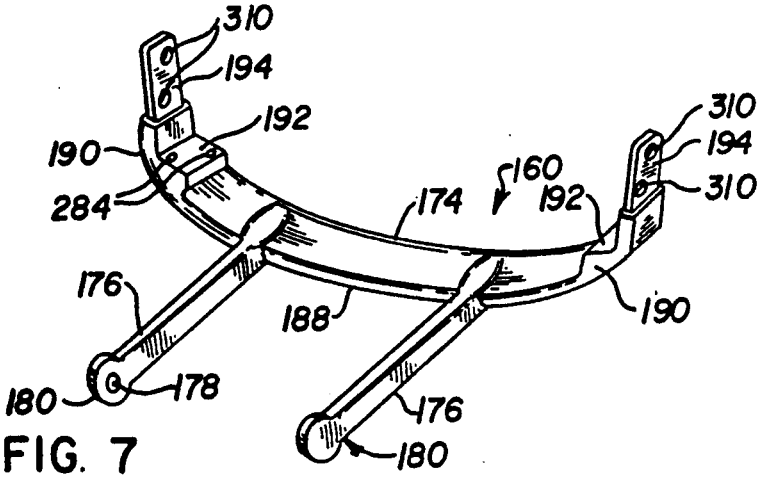
FIG. 7 is a perspective view of a seat support means or yoke of the tilt adjustment mechanism in accordance with the invention.

Referring specifically to FIGS. 3 and 7, the chair back support means or yoke 160 comprises a U-shaped support 174 and two parallel, spaced-apart arms 176. As stated above, the yoke 160 is rotatably mounted to the housing 34 for movement between upright and reclining positions. To this end, each arm 176 has a socket 178 on an outer end 180 of the arm rotatably receiving yoke pins 182. The yoke pins 182 are in turn rotatably mounted to the housing 34 in registry with the through openings 86 at opposite lateral sides 88, 90 of the housing. Screws 184 extend through aligned holes 186 in the housing gussetlike members 92 to, in combination with the arms 176, retain the pins within the openings 86. The arms 178 are sufficiently spaced and are of sufficient length to allow for free rotation of the yoke 160 relative to the housing 34.

The U-shaped support 174 comprises a web portion 188 and upwardly curving side portions 190. The side portions 190 have identical horizontal step portions 192 and identical vertical end portions 194. The step portions 192 function to support the chair back 162 as described below. The end portions 194 facilitate placement of chair armrests as is also described below. The yoke 160 is preferably made of cast aluminum.

Figure 5:
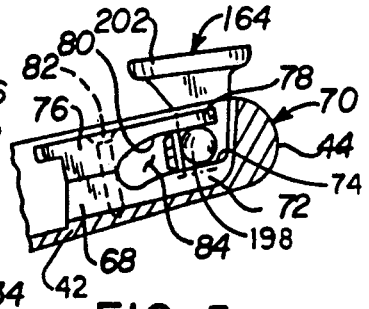
FIG. 5 is a sectional view of the housing taken along lines 5—5 of FIG. 3.
Figure 6:
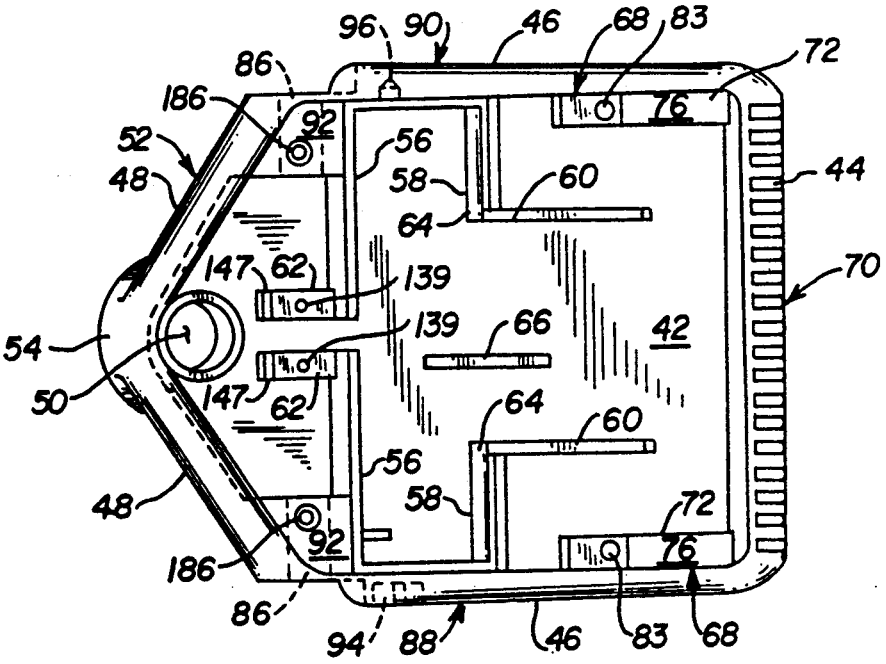
FIG. 6 is a plan view of the housing.
Figure 10:
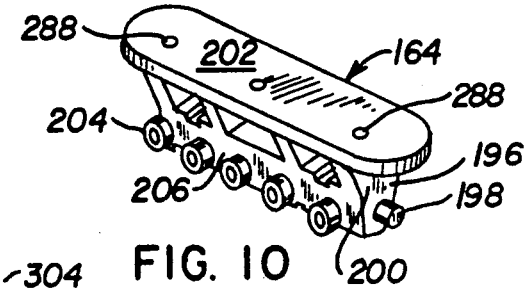
FIG. 10 is a perspective view of a seat support means or plunger of the tilt adjustment mechanism.

As illustrated in FIGS. 3, 5 and 10 the seat support means or plunger 164 is pivotally and slidably mounted to the housing 34 for movement in rearward and forward directions. To this end, the plunger 164 comprises a generally T-shaped body 196 and an outwardly projecting pin 198 on each lateral side wall 200 of the body.

The pins 198 are rotatably and slidably received within the arcuate slots 84 at the front portion 70 of the housing 34 to slidably mount the plunger to the same. The T-shaped body 196 further includes an upper horizontal platelike portion 202 to which the chair seat 166 is mounted as described below. In this manner, the seat 166 is movable along with the plunger 164 in the forward and rearward directions during operation of the tilt adjustment mechanism. The plunger 164 further includes a plurality of rearwardly projecting pins 204 on a back wall 206 of the body 196. The pins 204 function in connection with the biasing means 170 as discussed below.

Although the slots 84 can be linearly formed to guide the plunger along a straight path in forward and rearward directions, the slots are preferably slightly curved to guide the plunger along an arcuate path to promote smooth operation of the tilt adjustment mechanism.

Referring to FIG. 3, the biasing means 170 comprises sets of adjustable and nonadjustable springs 208, 210, respectively, mounted within the housing 34 in such a manner as to resist movement of the seat support means or plunger 64 in the rearward direction and the back support means or yoke 160 toward the reclining position. Specifically, the nonadjustable springs 210 are mounted to and between the housing flanges 58 and the plunger 164, with the spring rear ends 212 bearing against the flanges 58 and the spring front ends 214 bearing against the plunger back wall 206 and receiving certain of the rearwardly projecting pins 204 thereon, the pins assisting in the mounting of the springs within the housing. The adjustable springs 208 are mounted to and between the tension control means 172, as discussed below, and the plunger back wall 206, with the adjustable spring front ends 268 receiving other of the pins 204 on the plunger back wall.

The tension control means 172 functions to adjust tension or potential of the adjustable springs 208 to thereby adjust the same's resistance to rearward movement of the seat support means or plunger 164 and movement of the back support means or yoke 160 toward the reclining position. The tension control means 172 comprises an adjustment rod 216, a wedge 218 (hereinafter sometimes the "first blocklike member") and a compression carriage 220 (hereinafter sometimes the "second blocklike member").

As illustrated in FIG. 3, the adjustment rod 216 is rotatably mounted to the housing side walls 46 at the housing lateral sides 88, 90 in registry with the bores 94, 96. Specifically, the rod 216 comprises a first portion 222 telescopically received by the actuating tube 112 of the height adjustment mechanism, and a second threaded portion 224 outside of the actuating tube. The rod 216 also includes a first end 226 positioned outside of the housing 34 and the actuating tube 112, and a second end 228 positioned inside of the housing adjacent the threaded portion 224 of the rod. The rod first end 226 carries a knob 230 thereon adjacent the handle 124 of the actuating tube 112. The rod second end 228 carries a pin 232 in rotatable registry with the bore 96 and engaging the side wall 46 at the housing lateral side 90.

Figure 8:
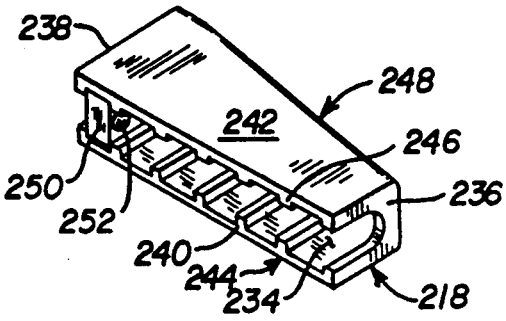
FIG. 8 is a perspective view of a wedge of the tilt adjustment mechanism.

As shown in FIGS. 3 and 8, the wedge 218 is a hollow, substantially right triangular member having a rearwardly opening U-shaped slot 234 through one side wall 236 of the wedge. Opposite side wall 238 is substantially open. A plurality of internal transverse ribs 240 formed on upper and lower sides 242, 244 of the wedge 218 function to enhance structural rigidity of the same. A back side 246 of the wedge is also substantially open, a sloping front wall 248 thereof being solid. A nut 250 is mounted within the wedge 218 and substantially closes off the open side 238 thereof. The nut 250 includes a threaded hole 252 aligned with the U-shaped slot 234. The inner portion 114 of the actuating tube 112, and the adjustment rod 216 received therein, is positioned within the wedge 218 in registry with the U-shaped slot 234. The second threaded portion 224 of the rod 216 engages the nut 250 in registry with the hole 252. The wedge 218 is preferably made of plastic, such as Delrin.

The wedge 218 is positioned within the housing between the bottom wall 42 thereof and a top wall or cover 254 of the housing. The cover 254 is not specifically shown in FIG. 3, but is illustrated in greater detail in FIG. 11. The bottom and top walls 42, 254 (hereinafter sometimes collectively the "interference means") interfere with rotation of the wedge 218 upon rotation of the actuating rod 216 to effect linear movement of the wedge in first and second directions normal to movement of the seat support means 164 in the forward and rearward directions. The wedge 218 also slidably engages and is positioned between the housing flanges 56, 58. The flanges 56, 58 are longitudinally aligned with directional movement of the wedge 218 and therefore function to guide the same in the first and second directions.

Figure 9:
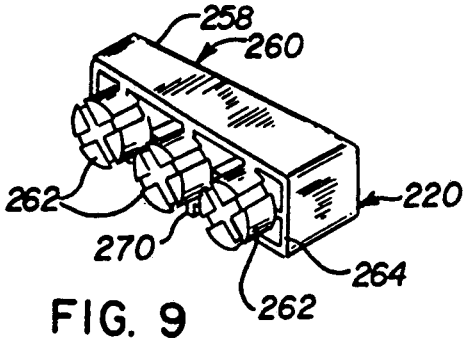
FIG. 9 is a perspective view of a carriage of the tilt adjustment mechanism.

Referring to FIGS. 3 and 9, the carriage 220 comprises a somewhat triangular body 258 having a sloping rear face 260 complementary with and engaging the sloping front wall 248 of the wedge 218. As stated above, the adjustable coil springs 208 of the biasing means 170 are positioned between the seat support means 164 and the tension control means 172. To this end, the carriage 220 includes a plurality of forwardly protecting pins 262 on a front face 264 of the carriage. The pins 262 receive rear ends 266 of the adjustable springs 208, front ends 268 thereof being received by the pins 204 of the seat support means as heretofore described. The carriage 220 is moveable in the housing 34 in the forward and rearward directions of the seat support means and is biased for movement in the rearward direction against the wedge 218, with the rear face 260 of the carriage in mating engagement with the complementary sloping front wall 248 of the wedge. The carriage is preferably made of a glass filled nylon material such as Zytel.

The carriage 220 engages and is movably position between the housing flanges 60. In this manner, the flanges 60 function to guide movement of the carriage in the forward and rearward directions. The carriage 220 further includes a downwardly extending flange 270 slidably received within the longitudinal groove 66 of the housing 34. The flange 70 and the groove 66 also function to guide the carriage 220 between the forward and rearward directions.

The complementary rear face 260 and the front wall 248 of the carriage 220 and the wedge 118, respectively are interengaged in a substantially common plane forming an acute angle relative to directional movement of the wedge in the first and second directions. In this manner, in operation of the tension control means 172, rotational adjustment of the actuating rod 216 effects movement of the wedge 218 in the first and second directions and the carriage 220 in the forward and rearward directions to increase and decrease tension of the adjustable springs 208. Thus, forward movement of the carriage 220 increases the compressive force of the springs 208, thereby increasing the resistance to rearward movement of the seat support means 164 and movement of the back support means 160 to the reclining position. Conversely, rearward movement of the carriage 220 decreases the compressive force of the adjustable springs 208, thereby decreasing the springs' resistance against to rearward movement of the seat support means 164 and movement of the back support means 160 to the reclining position.

As stated above, the pivot means 168 operably connects the seat and back support means and specifically forms a pivotal or hinged connection between the chair seat 166 and the back 162. As shown in FIGS. 1, 2, 14–16, the seat 166 and the back 162 are formed of a two-piece outer shell 272, a two-piece inner shell 274 and a cushion 276. The outer shell 272 includes an outer back portion 278 and an outer seat portion 280. The outer back portion 278 is securely mounted on the U-shaped support 174 of the back support means 160 by pairs of screws (not shown) engaging and extending through aligned pairs of holes 284 in the outer back portion and the step portion 192 of the U-shaped support. The outer seat portion 280 is securely mounted on the seat support means 164 by a plurality of screws (not shown) engaging and extending through aligned sets of holes 288 in the outer seat portion and the upper plate-like portion 202 of the seat support means.

The inner shell 274 comprises an inner back portion 290 and an inner seat portion 292. The inner back and seat portions 290, 292 are mounted to the outer back and seat portions 278, 280, respectively, in snap fit relationship by fastening means well known in the art. The inner back and seat portions 290, 292 are connected together by the cushion 276 adhesively bonded to the inner back and seat portions. The cushion 276 is preferably upholstered and serves aesthetic and comfort purposes as well as functioning to connect the inner back and seat portions together. Spaces 293 between the inner and outer shell receive fabric (not shown) covering the seat and back.

Figure 15:
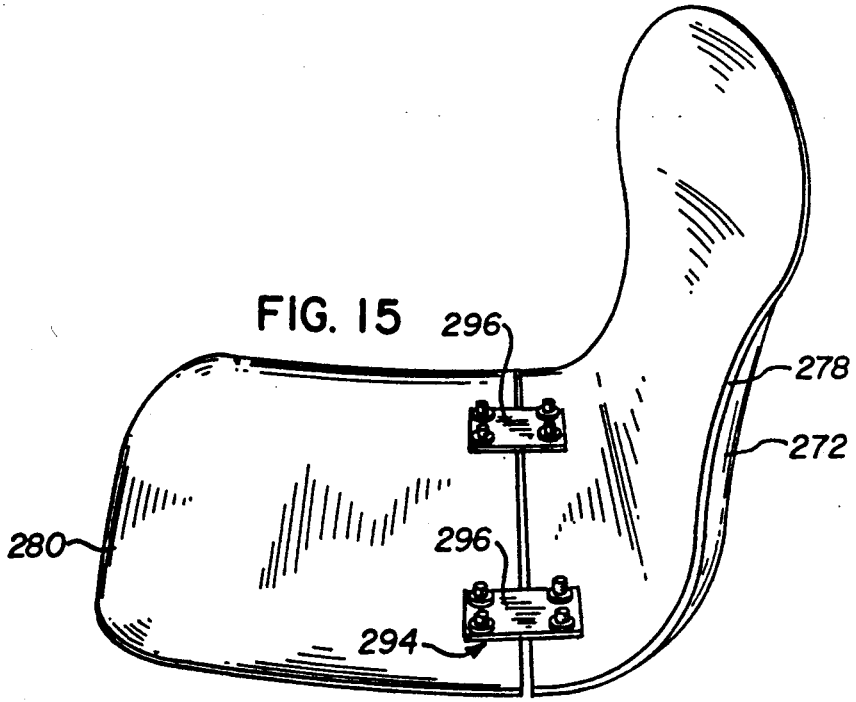
FIG. 15 is a front perspective view of an outer shell of the chair seat and back, showing a composite hinged connection between outer seat and back portions of the outer shell.
Figure 16:
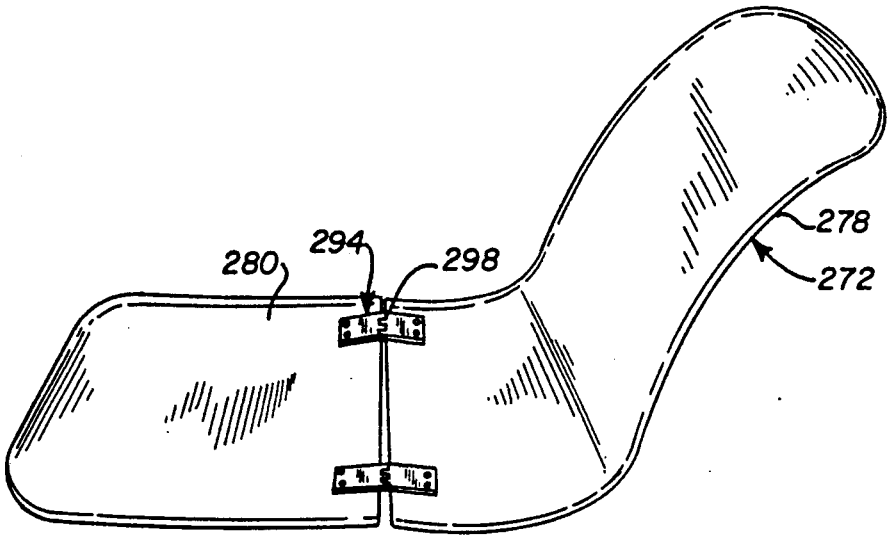
FIG. 16 is a front perspective view of the outer shell of the seat and back, showing a true hinged connection between the outer seat and back portions of the outer shell.

Referring now to FIGS. 15–16, the pivot means 168 comprises a hinge 294 mounted to and between the outer back and seat portions 278, 280 to pivotably mount the same together and thus hingeably mount the chair seat 166 to the back 162. As specifically shown in FIG. 15, the hinge 294 preferably comprises at least two resilient members 296 made of a composite plastic material such as polyisocyanate. The inherent resiliency of the members 296 provides resistance to pivotal movement of the back 162 relative to the seat 166 during downward and rearward tilting of the back support means toward the reclining position. This has been found to provide smoother operation of the chair during such tilting operation than when a true hinge 298 is used to pivotally connect the outer back and seat portions 278, 280 as specifically illustrated in FIG. 16.

The inner and outer shells are preferably made of resilient plastic material such as polypropylene.

Figure 17:
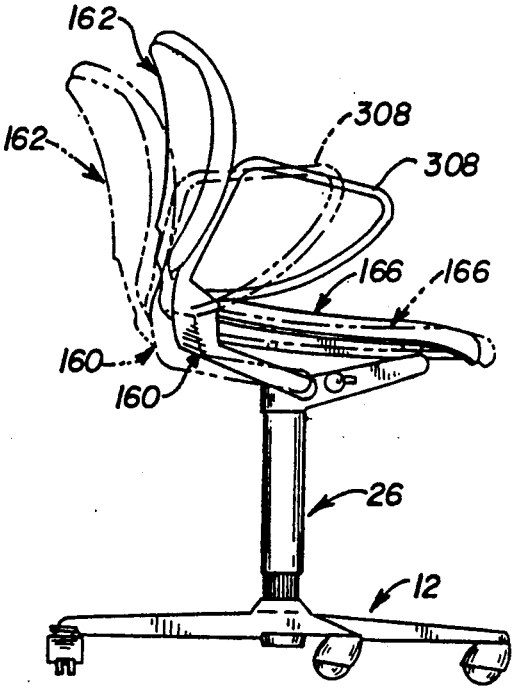
FIG. 17 is a side elevational view of the chair seat and back, showing the same in solid lines in their forward and upright positions and in phantom lines in their rearward and reclining positions.

In operation of the tilt adjustment mechanism, referring specifically to FIG. 17, when rearward and downward forces are applied to the chair back 162, the back support means 160 rotates and pivots counterclockwise, thereby causing the back to move rearwardly and downwardly toward the reclining position and to pivot relative to the seat 166 by virtue of the pivot means 168. At the same time, forces are exerted on the seat 166 causing the seat support means 164 to move rearwardly and slightly downwardly in the arcuate slots 84 in the rearward direction against the force of the adjustable and nonadjustable springs 208, 210. When the rearward forces on the back are released, the springs 208, 210 force the seat support means 164 in the forward direction to thus move the back 162 to its original upright position.

Figure 11:
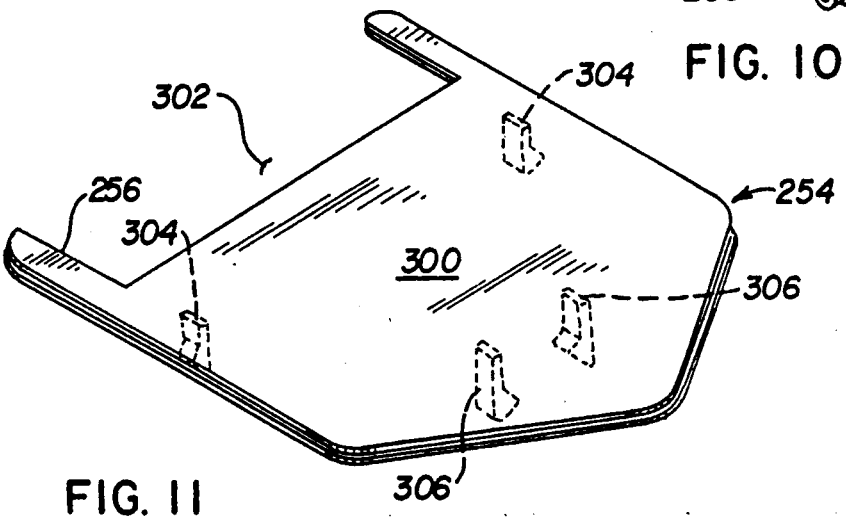
FIG. 11 is a perspective view of a cover or top wall of the housing.
Figure 12:
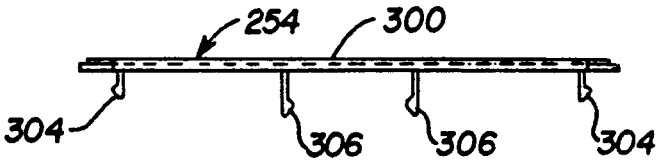
FIG. 12 is a front elevational view of the housing cover.

The housing top wall or cover 254 is mounted on the housing 34 directly below the outer seat portion 280 of the seat 166. The cover 254 functions to protect the tilt and height adjustment mechanism components from dust. As shown in FIGS. 11 and 12, the cover 254 comprises a generally pentagonal plate 300 having a rectangular cut out portion 302 through which the seat support means 164 can operate in the forward and rearward directions. Tabs 304, 306 extend downwardly from the plate 300 to removably secure the cover 254 to the housing 34. Specifically the tabs 304 removably the side walls 46 of the housing 34, while the tabs 306 engage the housing flanges 62. The cover 254 is preferably made of polystyrene.

Referring to FIGS. 1 and 2, the chair armrests 308 each comprise a generally triangular shaped metal frame (not shown) having a somewhat rounded upper portion. The armrests 308 are mounted on the end portions 194 of the seat support means 164 by bolts (not shown) engaging and extending through aligned holes 310 in the armrest frame and the end portions 194. (See FIG. 7.) The armrest frames are covered with a fabric or plastic material to provide comfort to the user.

While the invention has been described in connection with a preferred embodiment, it will be understood that the invention will not be limited to that embodiment. To the contrary, all alternative modifications and equivalents as may be included with the spirit and scope of the invention as defined by the appended claims are intended.

The embodiments of the invention in which an exclusive property and privilege is claimed are defined as follows:

1. A chair having a seat, a back and a base, said seat and back each being pivotally mounted to the base and the seat and back further being pivotally connected to each other so that the back and seat move synchronously and the back pivots at a rate proportional to the seat as one of the seat and back is pivoted, a tilt mechanism between the base and the seat for controlling said synchronous movement, the tilt mechanism comprising a stationary housing mounted to the base, said housing having opposed top and bottom walls, a seat support member slidably mounted to the housing for movement between fore and aft positions, said seat being mounted to the seat support member, a spring mounted within the housing for biasing the seat toward the fore position, and an adjustment mechanism for adjusting the force of the spring, wherein the spring force, adjustment mechanism comprises:

an actuating rod journaled to the housing for rotation relative thereto and having a portion thereof within the housing and an outward portion thereof extending laterally outwardly of the housing to a point approximately in a vertical plane extending through a side edge of the seat, a wedge mounted to the rod within the housing and positioned between said top and bottom walls for movement along the rod in response to rotation of the rod, said bottom and top walls interfering with rotation of the wedge upon rotation of the rod to effect linear movement of the wedge along the rod, and a carriage disposed within the housing in engagement with the wedge for movement in a direction transverse to the axis of the rod, the spring being mounted between the carriage and the seat support member to resist movement of the seat support member toward the aft position as the spring is compressed and the force of the spring resistance being adjustable by rotation of the rod.

2. A chair according to claim 1 wherein said housing comprises a pair of spaced first and second side walls, said first side wall having an opening extending therethrough, said second side wall having a hole therein aligned with said opening; and said actuating rod further comprises a pin on and extending longitudinally outwardly from said rod inner end, said rod being rotatably mounted to and between said side walls, with said rod outer end being received in said opening and said pin being received in said hole.

3. A chair according to claim 2 wherein said actuating means further comprises a tubular handle fixedly mounted on said rod outer end in telescopic relationship thereto for facilitating rotation of said rod.

4. A chair according to claim 1 wherein said housing comprises a bottom wall; and a pair of spaced inner walls extending upwardly from said bottom wall and longitudinally aligned with directional movement of said wedge, said inner walls receiving said wedge therebetween and at least one of said walls being engageable with said wedge to guide the same along the rod.

5. A chair according to claim 1 wherein said housing comprises a bottom wall; and a pair of spaced inner walls extending upwardly from said bottom wall and longitudinally aligned with directional movement of said carriage, said inner walls receiving said carriage therebetween and at least one of said walls being engageable with said carriage to guide movement of the same.

6. A chair according to claim 1 wherein said housing comprises a bottom wall having a channel formed therein and longitudinally aligned with directional movement of said carriage, and said carriage has a downwardly depending flange thereon, said channel receiving said flange to guide movement of said carriage.

7. A chair according to claim 1 wherein said housing comprises a bottom wall;

a pair of spaced inner walls extending upwardly from said bottom wall and longitudinally aligned with directional movement of said wedge, said inner walls receiving said wedge therebetween and at least one of said walls being engageable with said wedge to guide the same along the rod; and a pair of spaced inner walls extending upwardly from said bottom wall and longitudinally aligned with directional movement of said carriage, said inner walls receiving said carriage therebetween and at least one of said walls being engageable with said carriage to guide movement of the same.

8. A chair according to claim 7 wherein said bottom wall has a channel formed therein and longitudinally aligned with directional movement of said carriage, and said carriage has a downwardly depending flange thereon, said channel receiving said flange to guide movement of said carriage.

9. A chair according to claim 1 wherein said spring is a coil spring having front and rear ends; and said seat support member comprises at least one first pin extending rearwardly from a back surface thereof and said carriage has at least one second pin extending forwardly from a front surface thereof and linearly aligned with said first pin in parallel relationship to directional movement of said carriage, said spring front and rear ends engaging said rear and front surfaces of said seat support member and said carriage, respectively, with said first and second pins being received in said coil spring at said front and rear ends thereof, respectively.

10. A chair according to claim 9 wherein said housing comprises an inner wall and a second spring is further positioned between said seat support means and said inner wall whereby the force of the second spring is not adjustable by rotation of the rod.

11. A chair according to claim 10 wherein said second spring is a coil spring having front and rear ends and at least one third pin extends rearwardly from said back surface of said seat support member, said second spring rear end engaging said inner wall, said second spring front end engaging said rear surface, with the third pin being received in said second spring at said front end thereof.

12. A chair according to claim 1, wherein the housing further comprises a track longitudinally aligned with directional movement of said seat support member, and said seat support member is slidably mounted to said track for movement in forward and rearward directions.

13. A chair according to claim 12 wherein said track comprises at least one retainer bracket mounted to said housing and having an elongated slot therein longitudinally aligned with directional movement of said seat support member and formed by a pair of spaced flanges of said retainer bracket; and at least one pin on said support member is slidably received within said slot between said spaced flanges.

14. A chair according to claim 13 wherein said pin is substantially circular, in cross section, and is adapted to rotate in said slot;

whereby movement of said back toward said reclining position in response to rearward forces applied thereto effects rotational movement to said seat support member along with movement thereof in said rearward direction.

15. A chair according to claim 14 wherein said housing comprises opposed side walls;

said track comprises a pair of opposed retainer brackets mounted to said side walls, each bracket having an elongated slot longitudinally aligned with directional movement of said seat support member and formed by a pair of spaced flanges of said retainer bracket;

said seat support member is positioned between said retainer brackets and has a pair of opposite end walls; and a pair of pins are mounted on and extend outwardly from said seat support end walls in opposite directions, said pins being slidably received within said slots between said pairs of spaced flanges.

16. A chair according to claim 1 further comprising a back support member pivotably mounted to the housing, said back being mounted to the back support member, and a hinge connecting the seat to the back whereby the back will rotate relative to the seat as the back and seat are moved to a reclining position.

17. A chair according to claim 16 wherein the hinge comprises at least one flexible member securely mounted to and between the seat and the back.

18. In a chair according to claim 17 wherein said flexible member is formed of a composite plastic.

19. A chair having a seat, a back and a base, said seat and back each being pivotally mounted to the base and the seat and back further being pivotally connected to each other so that the back and seat move synchronously and the back pivots at a rate proportional to the seat as one of the seat and back is pivoted, said chair comprising:

a stationary housing mounted to the base, said stationary housing having a first side wall and an opposed second side wall, said first side wall having an aperture extending therethrough sand said second side wall having a recess therein aligned with the aperture laterally relative to the seat, a seat support member slidably mounted to the housing for movement between fore and aft positions, said seat being mounted to the seat support member, an actuating rod journaled to the housing through the aperture and having a first end thereof received in the recess and a second end thereof extending laterally outwardly of the housing to a point approximately in a vertical plane extending through a side edge of the seat, a wedge threadably mounted to the rod within the housing for movement along the rod in response to rotation of the rod, said wedge having a first planar surface disposed at an acute angle relative to the longitudinal axis of the actuating rod, a carriage disposed within the housing having a second planar surface in flush engagement with the first planar surface, means within the housing to constrain movement of the carriage in a direction transverse to the longitudinal axis of the rod, and a spring mounted within the housing between the carriage and the seat support member to resist movement of the seat support member toward the aft position as the spring is compressed whereby the spring force is adjustable by rotation of the rod and the rod is conveniently accessible by a person sitting in the chair.

20. A chair according to claim 19 wherein said housing comprises a bottom wall; and said constraining means comprises a pair of spaced inner walls extending upwardly from said bottom wall and longitudinally aligned with directional movement of said carriage, said inner walls receiving said carriage therebetween and at least one of said walls being engageable with said carriage to guide movement of the same.

21. A chair according to claim 20 wherein said bottom wall has a channel formed therein and longitudinally aligned with directional movement of said carriage, and said carriage has a downwardly depending flange thereon, said channel receiving said flange to guide movement of said carriage.

22. A chair according to claim 20 wherein said housing comprises a third inner wall between the first side wall and one of the spaced inner walls normal to the axis of the spring, and a second spring is further positioned between said seat support means and said third inner wall whereby the force of the second spring is not adjustable by rotation of the rod.

23. A chair according to claim 22 wherein said second spring is a coil spring.

24. A chair according to claim 19 wherein said bottom wall has a channel formed therein and longitudinally aligned with directional movement of said carriage, and said carriage has a downwardly depending flange thereon, said channel receiving said flange to guide movement of said carriage.

25. A chair having a seat, a back and a base, said seat and back each being pivotally mounted to the base and the seat and back further being pivotally connected to each other so that the back and seat move synchronously and the back pivots at a rate proportional to the seat as one of the seat and back is pivoted, said chair comprising:

a stationary housing mounted to the base, said stationary housing having a first side wall and an opposing second side wall, said first side wall having an aperture extending therethrough, a seat support member slidably mounted to the housing for movement between fore and aft positions, said seat being fixedly mounted to the seat support member, an actuating rod journaled to the housing through the aperture and having an inward portion thereof disposed within the housing mounted for rotation to the second side wall and an outward portion thereof extending laterally outwardly of the housing to a point approximately in a vertical plane extending through a side edge of the seat, a wedge threadably mounted to the portion of the rod within the housing for movement along the rod in response to rotation of the rod, said wedge having a first planar surface disposed at an acute angle relative to the longitudinal axis of the actuating rod, a carriage disposed within the housing having a second planar surface in flush engagement with the first planar surface, resisting means within the housing to resist rotation of the wedge with the rod, constraining means within the housing to constrain movement of the carriage in a direction transverse to the longitudinal axis of the rod, and a spring mounted within the housing between the carriage and the seat support member to resist movement of the seat support member toward the aft position as the spring is compressed whereby the spring force is adjustable by rotation of the rod and the rod is conveniently accessible by a person sitting in the chair.

26. A chair according to claim 25 wherein said housing comprises a bottom wall, and said resisting means comprises an inner wall extending upwardly from said bottom wall and longitudinally aligned with directional movement of said wedge, said wedge having a second planar surface opposite the first planar surface and parallel to the longitudinal axis of the rod and in flush contact with the inner wall whereby to resist rotational movement of the wedge with the rod and to guide the same along the rod.

27. A chair according to claim 26 wherein said housing comprises a top wall; and said wedge is positioned in sandwiched relationship between said bottom and top walls so that said bottom and top walls will interfere with rotational movement of said wedge upon rotation of said actuating rod to effect linear movement of said wedge along the rod.

28. A chair according to claim 27 wherein said bottom wall has a channel formed therein and longitudinally aligned with directional movement of said carriage, and said carriage has a downwardly depending flange thereon, said channel receiving said flange to guide movement of said carriage.

29. A chair according to claim 26 wherein said constraining means comprises a pair of spaced inner walls extending upwardly from said bottom wall and longitudinally aligned with directional movement of said carriage, said inner walls receiving said carriage therebetween and at least one of said walls being engageable with said carriage to guide movement of the same.

30. A chair according to claim 29 wherein said bottom wall has a channel formed therein and longitudinally aligned with directional movement of said carriage, and said carriage has a downwardly depending flange thereon, said channel receiving said flange to guide movement of said carriage.

31. A chair according to claim 25 wherein said housing comprises a top wall and a bottom wall; and aid wedge is positioned in sandwiched relationship between said bottom and top walls so that said bottom and top walls will interfere with rotational movement of said wedge upon rotation of said actuating rod to effect linear movement of said wedge along the rod.

32. A chair according to claim 31 wherein said constraining means comprises a pair of spaced inner walls extending upwardly from said bottom wall and longitudinally aligned with directional movement of said carriage, said inner walls receiving said carriage therebetween and at least one of said walls being engageable with said carriage to guide movement of the same.

33. A chair according to claim 32 wherein said bottom wall has a channel formed therein and longitudinally aligned with directional movement of said carriage, and said carriage has a downwardly depending flange thereon, said channel receiving said flange to guide movement of said carriage.

* * * * *

UNITED STATES PATENT AND TRADEMARK OFFICE

CERTIFICATE OF CORRECTION

PATENT NO. : 5,192,114

DATED : March 9, 1993

INVENTOR(S) : GEOFFREY A. HOLLINGTON et al.

It is certified that error appears in the above-identified patent and that said Letters Patent is hereby corrected as shown below:

Claim 1, column 10, line 60:
"force, adjustment" should be --force adjustment--;

Claim 19, column 13, line 27:
"sand" should be --and--;

Claim 31, column 16, line 10:
"aid" should be --said--.

Signed and Sealed this

Fifteenth Day of March, 1994

*Attest:*

Bruce Lehman

BRUCE LEHMAN

*Attesting Officer*

*Commissioner of Patents and Trademarks*